US007409731B1

(12) United States Patent
Arteaga et al.

(10) Patent No.: US 7,409,731 B1
(45) Date of Patent: Aug. 12, 2008

(54) DISPOSABLE WASTE LINER ASSEMBLY

(76) Inventors: Jennifer G. Arteaga, 4361 Mission Blvd. Space 176, Montclair, CA (US) 91763; Sabrina Marie Arteaga, 4361 Mission Blvd. Space 176, Montclair, CA (US) 91763

( * ) Notice: Subject to any disclaimer, the term of this patent is extended or adjusted under 35 U.S.C. 154(b) by 41 days.

(21) Appl. No.: 11/372,772

(22) Filed: Mar. 13, 2006

(51) Int. Cl.
*A47K 11/06* (2006.01)

(52) U.S. Cl. ..... 4/484

(58) Field of Classification Search ..... 4/484; 220/495.06; 604/385.01
See application file for complete search history.

(56) References Cited

U.S. PATENT DOCUMENTS

| | | | | |
|---|---|---|---|---|
| 1,978,871 | A * | 10/1934 | Thuren | 4/484 |
| 3,381,315 | A * | 5/1968 | Glassberg | 4/484 |
| 4,759,086 | A | 7/1988 | Booth-Cox | |
| 4,882,794 | A | 11/1989 | Stewart, III | |
| 4,996,727 | A * | 3/1991 | Wyatt | 4/484 |
| D354,342 | S | 1/1995 | Marshall-Smith | |
| 6,186,990 | B1 | 2/2001 | Chen et al. | |
| 6,491,675 | B1 * | 12/2002 | Shimada et al. | 604/385.13 |
| 6,625,823 | B1 | 9/2003 | Abbott | |
| 6,694,535 | B1 * | 2/2004 | Gianesi Gschwind | 4/245.3 |
| 6,738,991 | B1 | 5/2004 | Dandreo et al. | |
| 7,150,050 | B2 * | 12/2006 | Sharp | 4/484 |
| 7,216,376 | B2 * | 5/2007 | Samuels | 4/484 |
| 2006/0080768 | A1 * | 4/2006 | Smith | 4/484 |

* cited by examiner

*Primary Examiner*—Charles E. Phillips

(57) ABSTRACT

A potty training assembly includes a flexible disposable and water-insoluble body that is adaptable between a bowl and a folded shape. The body includes a top fluid-absorbent layer and a bottom fluid-impermeable layer, which are coextensively shaped and lay contiguously against each other. The body has a top lip flanging outwardly and away from a center thereof and has a linear slit formed therein so the body can bifurcate into first and second portions. A mechanism is included for crystallizing human discharged fluids such that the fluids remain trapped within the top layer. A mechanism is included for securing the first and second portions to each other such that the first and second edges can become coupled. The adjustably securing mechanism is permanently affixed to the top lip of the body. A support bench includes an annular cavity formed therein. The body is removably seated within the cavity.

18 Claims, 4 Drawing Sheets

DISPOSABLE WASTE LINER ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to waste liners and, more particularly, to a disposable waste liner assembly.

2. Prior Art

The use of portable toilet training units by toddlers or of bedpans by patients or those who are bedridden requires that parents or other caretakers must clean the toilet training units or bedpans after they are used by the toddlers or patients. This is an unpleasant and time-consuming task, and may also aid in the spread of disease. Although there are many different shapes and designs of toilet seats, children's "potty chairs," training chairs, and commodes that are plastic or portable, they do not solve the problem of containing the waste products and allowing easy, neat and sanitary disposal of the waste products.

Various forms of potty chair liners and bedpan liners have been developed, yet remain unsatisfactory in design. One prior art example shows a potty chair liner that is capable of receiving solid and liquid human waste therein. Such a liner, after being used, claims to be flushable for simplifying cleaning procedures. However, the combined liner and solid waste can create a clog forming obstruction in the plumbing leading from the toilet to the exterior of the home, thus causing the user an increased amount of stress and discomfort. Such a clog may require the use of a plumber, which can be rather expensive, thus causing the liner to create only more inconvenience than what it was intended to avoid.

Accordingly, a need remains for a disposable waste liner assembly in order to overcome the above-noted shortcomings. The present invention satisfies such a need by providing a waste liner assembly that is convenient and easy to use, provides considerable time savings, and is practical for many applications. Such a disposable liner helps to make toilet training easier for parents and other caregivers of young toddlers. Instead of emptying and washing the potty chair receptacle after each use, a parent simply removes and disposes of the soiled liner. Removing and replacing the liners is quickly and easily accomplished, without ever coming in contact with the urine or feces.

BRIEF SUMMARY OF THE INVENTION

In view of the foregoing background, it is therefore an object of the present invention to provide a disposable waste liner assembly. These and other objects, features, and advantages of the invention are provided by a potty training assembly for conveniently receiving and disposing of human excrements within minimal human contact.

The potty training assembly includes a flexible body that is adaptable between a bowl shape and a folded shape during operating and non-operating conditions respectively. Such a body is formed from disposable and water-insoluble material. The body includes a top fluid-absorbent layer and a bottom fluid-impermeable layer directly affixed thereto. Such a top layer has a thickness greater than a thickness of the bottom layer. The top and bottom layers are coextensively shaped and lay contiguously against each other along an entire surface area of the body. Such a body further has a top lip flanging outwardly and away from a center of the body. The bottom layer preferably defines the top lip of the body. The top layer terminates prior to reaching the top lip.

The body also has a linear slit formed therein such that the body is bifurcated into first and second portions that are removably conjoined directly to each other. Each of the first and second portions has a flexible interior edge directly engaged when the body is maintained at the bowl shape. Such first and second edges are separated when the body is adapted to the folded shape.

A mechanism is included for crystallizing human discharged fluids such that the fluids become absorbed by the top layer and are thereby crystallized in such a manner that the crystallized fluids advantageously and effectively remain trapped within the top layer and are prohibited from penetrating to the bottom layer. Such a fluid crystallizing mechanism preferably includes a predetermined and safe quantity of odorless water-absorbing polymer granules that are randomly impregnated throughout the top layer. The polymer granules include polyacrylamide. Such polymer granules may be spaced from the bottom layer and remain isolated therefrom after the fluid is absorbed and crystallized.

A mechanism is included for adjustably securing the first and second portions to each other such that the first and second edges can contiguously couple directly to each other during operating conditions. Such an adjustably securing mechanism is permanently affixed to the top lip of the body and further is diametrically oriented therealong. The adjustably securing mechanism may include first and second adhesive tabs that are directly connected to the top lip of the body. Such a first tab is disposed at the interior edge of the first portion such that the interior edge of the second portion can be folded downwardly and inwardly into the first portion thereby permitting the first and second tabs to maintain the second portion folded within the first portion.

A support bench includes an annular cavity formed therein. The body is removably seated within the cavity such that the top lip of the body remains exposed above the cavity during operating conditions. The bench preferably includes a bottom surface and a plurality of side walls that are monolithically formed therewith for advantageously and conveniently providing privacy to a user when seated on the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
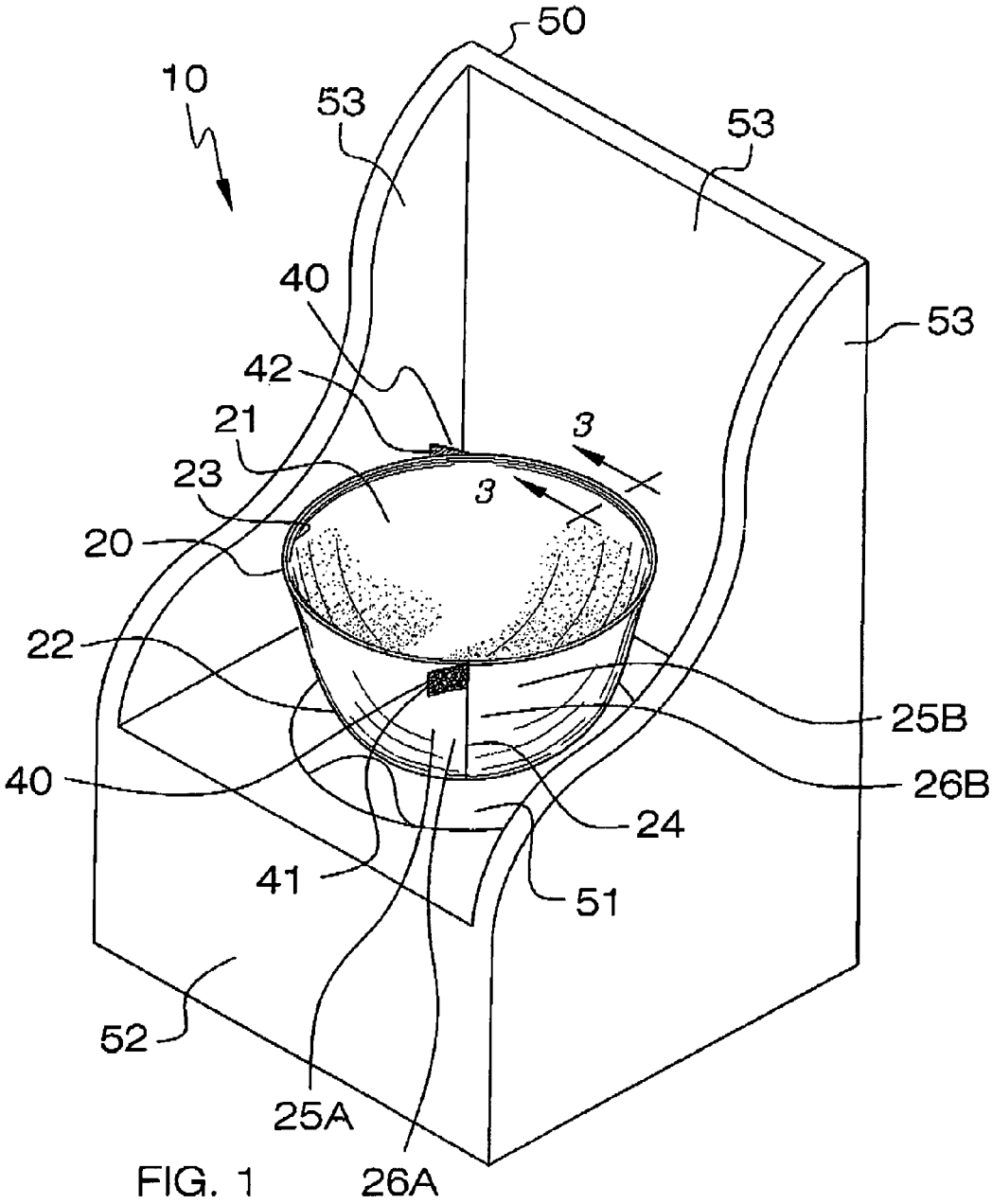
FIG. 1 is a perspective view showing a disposable waste liner assembly, in accordance with the present invention.
Figure 2:
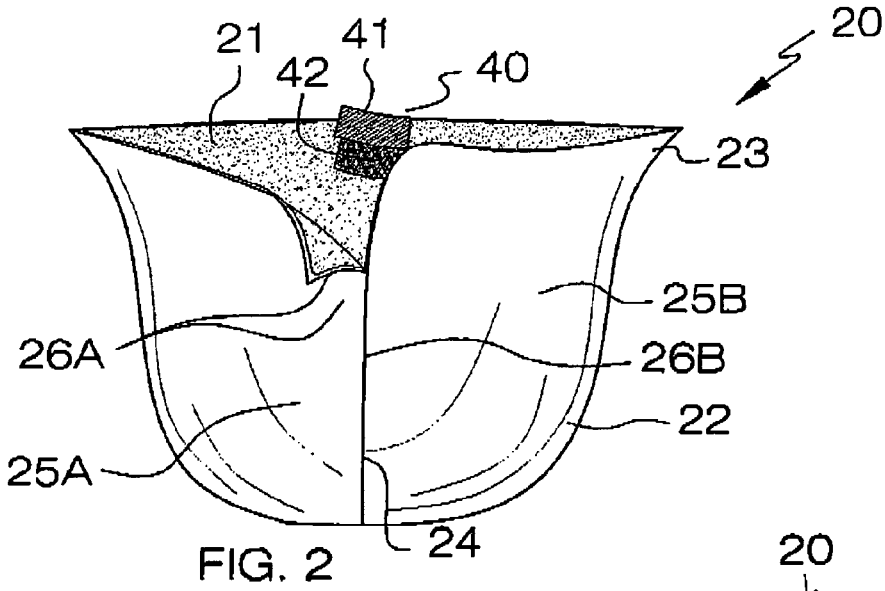
FIG. 2 is a side-elevational view of the flexible body shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-5 by the reference numeral 10 and is intended to provide a disposable waste liner assembly. It should be understood that the assembly 10 may be used to line many different types of defecating apparatuses and should not be limited in use to only lining potty chairs.

Referring initially to FIGS. 1 through 5, the assembly 10 includes a flexible body 20 that is adaptable between a bowl shape and a folded shape during operating and non-operating conditions respectively. Allowing the body 20 to be folded is an important feature for ensuring the body 20 occupies the least amount of space possible once same is deposited into a trash receptacle 11. Of course, the body 20 may be produced in a variety of alternate shapes and sizes for effectively conforming to bedpans and other portable forms of toilets, as is obvious to a person of ordinary skills in the art. Such a body 20 is formed from disposable and water-insoluble material, which is essential for allowing a user to conveniently discard of a used liner in the garbage. The body 20 includes a top fluid-absorbent layer 21 and a bottom fluid-impermeable layer 22 directly affixed, without the use of intervening elements, thereto. Such a top layer 21 has a thickness greater than a thickness of the bottom layer 22. The top 21 and bottom 22 layers are coextensively shaped and lay contiguously against each other along an entire surface area of the body 20. Such a body 20 further has a top lip 23 flanging outwardly and away from a center of the body 20. The bottom layer 22 defines the top lip 23 of the body 20. The top layer 21 terminates prior to reaching the top lip 23.

Referring to FIGS. 1, 2, 4 and 5, the body 20 also has a linear slit 24 formed therein such that the body 20 is bifurcated into first 25A and second 25B portions that are removably conjoined directly, without the use of intervening elements, to each other. Each of the first 25A and second 25B portions has a flexible interior edge 26 directly engaged, without the use of intervening elements, when the body 20 is maintained at the bowl shape, which is crucial for ensuring that the wastes deposited within the body 20 do not exit therefrom. Such first 26A and second 26B edges are separated when the body 20 is adapted to the folded shape.

Figure 3:
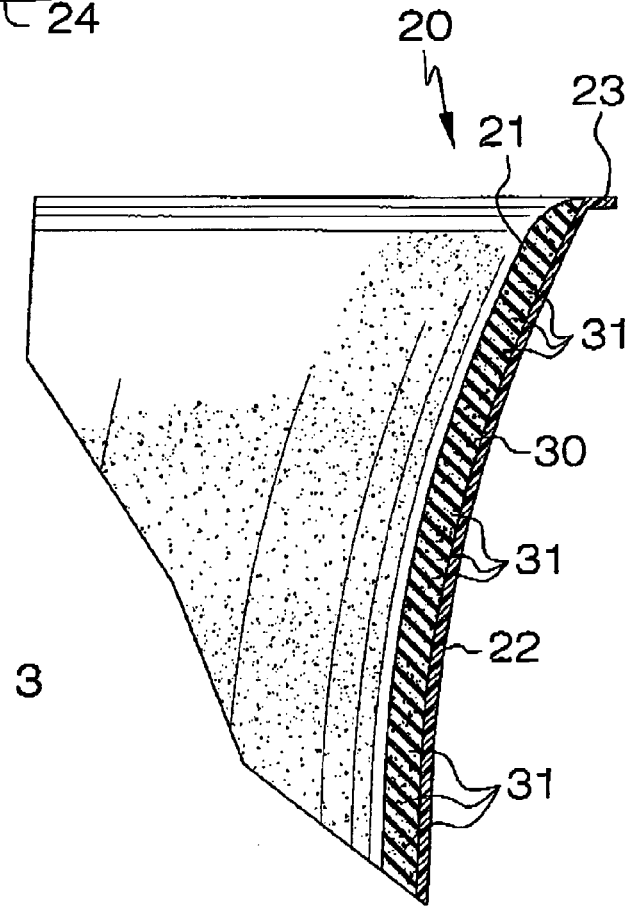
FIG. 3 is an enlarged cross-sectional view of the flexible body shown in FIG. 1, taken along line 3-3.
Figure 4:
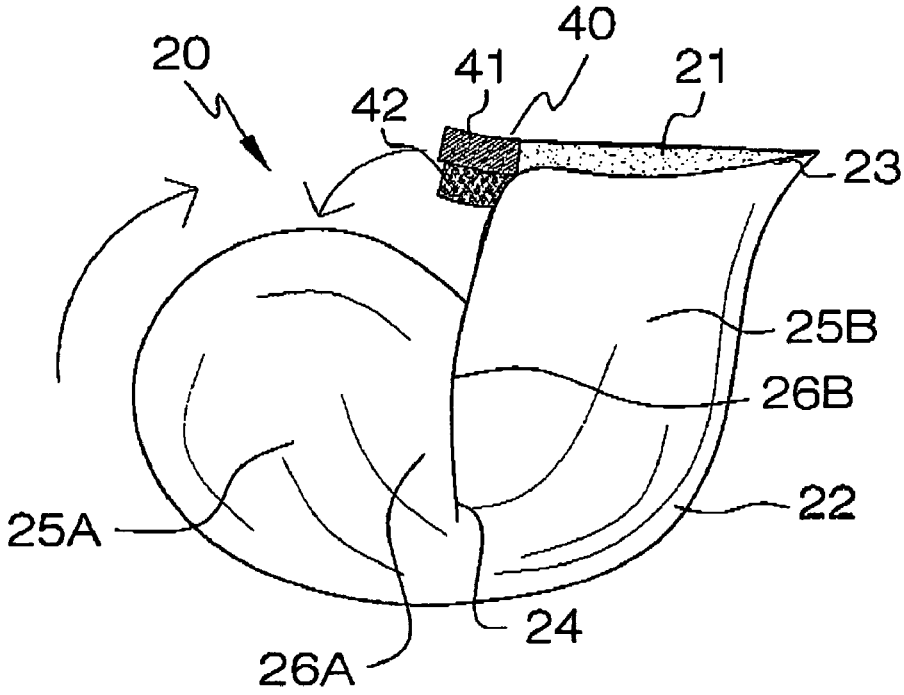
FIG. 4 is a side-elevational view of the flexible body shown in FIG. 2, showing the proper folding procedure for the liner.
Figure 5:
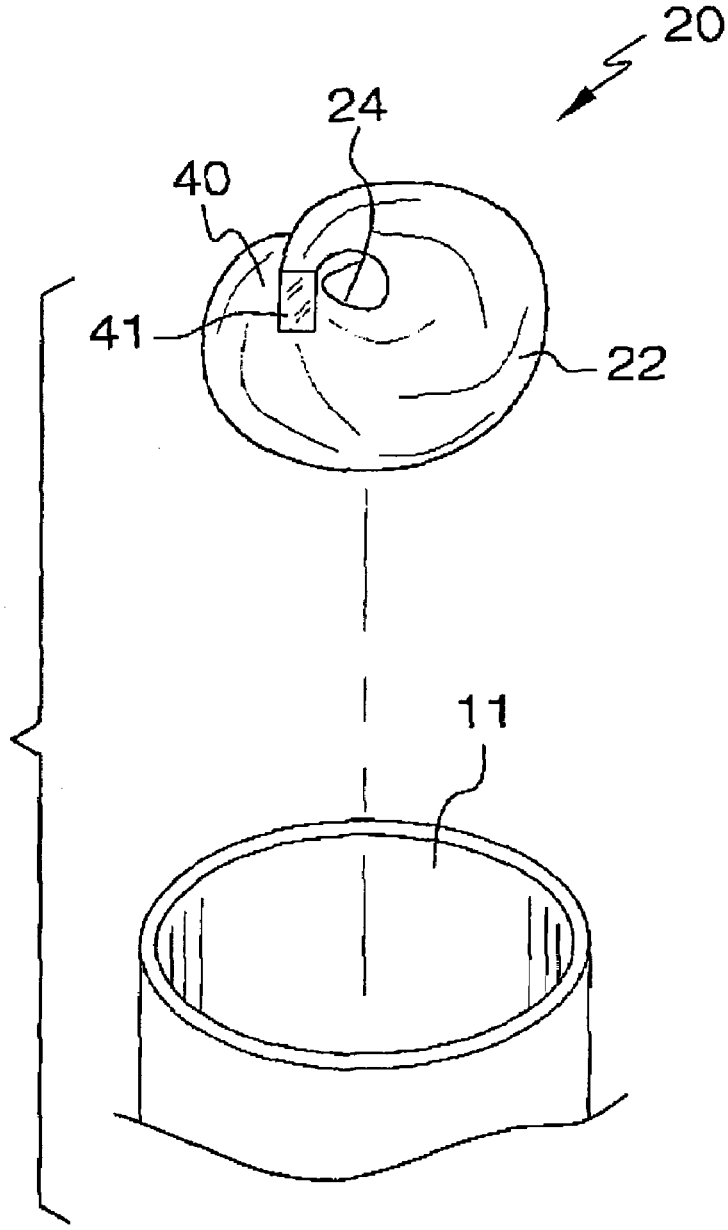
FIG. 5 is a perspective view of the flexible body shown in FIG. 4, showing the body at a completely folded state prior to being discarded.

Referring to FIG. 3, a mechanism 30 is included for crystallizing human discharged fluids such that the fluids become absorbed by the top layer 21 and are thereby crystallized in such a manner that the crystallized fluids advantageously and effectively remain trapped within the top layer 21 and are prohibited from penetrating to the bottom layer 22. Such a fluid crystallizing mechanism 30 includes a predetermined and safe quantity of odorless water-absorbing polymer granules 31 that are randomly impregnated throughout the top layer 21. The polymer granules 31 include polyacrylamide. Such polymer granules 31 are spaced from the bottom layer 22 and remain isolated therefrom after the fluid is absorbed and crystallized.

Referring to FIGS. 1, 2, 4 and 5, a mechanism 40 is included for adjustably securing the first 25A and second 25B portions to each other such that the first 26A and second 26B edges can contiguously couple directly, without the use of intervening elements, to each other during operating conditions. Such an adjustably securing mechanism 40 is permanently affixed to the top lip 23 of the body 20 and further is diametrically oriented therealong. The adjustably securing mechanism 40 includes first 41 and second 42 adhesive tabs that are directly connected, without the use of intervening elements, to the top lip 23 of the body 20. Such a first tab 41 is disposed at the interior edge 26A of the first portion 25A such that the interior edge 26B of the second portion 25B can effectively be folded downwardly and inwardly into the first portion 25A thereby permitting the first 41 and second 42 tabs to maintain the second portion 25B folded within the first portion 25A.

Referring to FIG. 1, a support bench 50 includes an annular cavity 51 formed therein. The body 20 is removably seated within the cavity 51 such that the top lip 23 of the body 20 remains exposed above the cavity 51 during operating conditions. The bench 50 includes a bottom surface 52 and a plurality of side walls 53 that are monolithically formed therewith, which is crucial and advantageous for conveniently providing privacy to a user when seated on the bench 50.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A potty training assembly for receiving and disposing of human excrements within minimal human contact, said potty training assembly comprising:

a flexible body adaptable between a bowl shape and a folded shape during operating and non-operating conditions respectively, said body including a top fluid-absorbent layer and a bottom fluid-impermeable layer directly affixed thereto, said top and bottom layers being coextensively shaped and laying contiguously against each other along an entire surface area of said body, said body further having a top lip flanging outwardly and away from a center of said body, said body further having a linear slit formed therein such that said body is bifurcated into first and second portions removably conjoined directly to each other, each of said first and second portions having a flexible interior edge directly engaged when said body is maintained at said bowl shape, said first and second edges being separated when said body is adapted to said folded shape;

means for crystallizing human discharged fluids such that said fluids become absorbed by said top layer and thereby crystallized in such a manner that said crystallized fluids remain trapped within said top layer and prohibited from penetrating to said bottom layer;

means for adjustably securing said first and second portions to each other such that said first and second edges can contiguously couple directly to each other during operating conditions, said adjustably securing means being permanently affixed to said top lip of said body and further being diametrically oriented therealong; and a support bench including an annular cavity formed therein, said body being removably seated within said cavity such that said top lip of said body remains exposed above said cavity during operating conditions.

2. The assembly of claim 1, wherein said fluid crystallizing means comprises:

a predetermined and safe quantity of odorless water-absorbing polymer granules randomly impregnated throughout said top layer, said polymer granules comprising polyacrylamide.

3. The assembly of claim 2, wherein said polymer granules are spaced from said bottom layer and remain isolated therefrom after the fluid is absorbed and crystallized.

4. The assembly of claim of claim 1, wherein said bottom layer defines said top lip of said body, said top layer terminating prior to reaching said top lip.

5. The assembly of claim 1, wherein said adjustably securing means comprises:

first and second adhesive tabs directly connected to said top lip of said body, said first tab being disposed at said interior edge of said first portion such that said interior edge of said second portion can be folded downwardly and inwardly into said first portion and thereby permit said first and second tabs to maintain said second portion folded within said first portion.

6. The assembly of claim 1, wherein said bench comprises:

a bottom surface and a plurality of side walls monolithically formed therewith for providing privacy to a user when seated on said body.

7. A potty training assembly for receiving and disposing of human excrements within minimal human contact, said potty training assembly comprising:

a flexible body adaptable between a bowl shape and a folded shape during operating and non-operating conditions respectively, said body including a top fluid-absorbent layer and a bottom fluid-impermeable layer directly affixed thereto, wherein said top layer has a thickness greater than a thickness of said bottom layer, said top and bottom layers being coextensively shaped and laying contiguously against each other along an entire surface area of said body, said body further having a top lip flanging outwardly and away from a center of said body, said body further having a linear slit formed therein such that said body is bifurcated into first and second portions removably conjoined directly to each other, each of said first and second portions having a flexible interior edge directly engaged when said body is maintained at said bowl shape, said first and second edges being separated when said body is adapted to said folded shape;

means for crystallizing human discharged fluids such that said fluids become absorbed by said top layer and thereby crystallized in such a manner that said crystallized fluids remain trapped within said top layer and prohibited from penetrating to said bottom layer;

means for adjustably securing said first and second portions to each other such that said first and second edges can contiguously couple directly to each other during operating conditions, said adjustably securing means being permanently affixed to said top lip of said body and further being diametrically oriented therealong; and a support bench including an annular cavity formed therein, said body being removably seated within said cavity such that said top lip of said body remains exposed above said cavity during operating conditions.

8. The assembly of claim 7, wherein said fluid crystallizing means comprises:

a predetermined and safe quantity of odorless water-absorbing polymer granules randomly impregnated throughout said top layer, said polymer granules comprising polyacrylamide.

9. The assembly of claim 8, wherein said polymer granules are spaced from said bottom layer and remain isolated therefrom after the fluid is absorbed and crystallized.

10. The assembly of claim of claim 7, wherein said bottom layer defines said top lip of said body, said top layer terminating prior to reaching said top lip.

11. The assembly of claim 7, wherein said adjustably securing means comprises:

first and second adhesive tabs directly connected to said top lip of said body, said first tab being disposed at said interior edge of said first portion such that said interior edge of said second portion can be folded downwardly and inwardly into said first portion and thereby permit said first and second tabs to maintain said second portion folded within said first portion.

12. The assembly of claim 7, wherein said bench comprises:

a bottom surface and a plurality of side walls monolithically formed therewith for providing privacy to a user when seated on said body.

13. A potty training assembly for receiving and disposing of human excrements within minimal human contact, said potty training assembly comprising:

a flexible body adaptable between a bowl shape and a folded shape during operating and non-operating conditions respectively, wherein said body is formed from disposable and water-insoluble material, said body including a top fluid-absorbent layer and a bottom fluid-impermeable layer directly affixed thereto, wherein said top layer has a thickness greater than a thickness of said bottom layer, said top and bottom layers being coextensively shaped and laying contiguously against each other along an entire surface area of said body, said body further having a top lip flanging outwardly and away from a center of said body, said body further having a linear slit formed therein such that said body is bifurcated into first and second portions removably conjoined directly to each other, each of said first and second portions having a flexible interior edge directly engaged when said body is maintained at said bowl shape, said first and second edges being separated when said body is adapted to said folded shape;

means for crystallizing human discharged fluids such that said fluids become absorbed by said top layer and thereby crystallized in such a manner that said crystallized fluids remain trapped within said top layer and prohibited from penetrating to said bottom layer;

means for adjustably securing said first and second portions to each other such that said first and second edges can contiguously couple directly to each other during operating conditions, said adjustably securing means being permanently affixed to said top lip of said body and further being diametrically oriented therealong; and a support bench including an annular cavity formed therein, said body being removably seated within said cavity such that said top lip of said body remains exposed above said cavity during operating conditions.

14. The assembly of claim 13, wherein said fluid crystallizing means comprises:

a predetermined and safe quantity of odorless water-absorbing polymer granules randomly impregnated throughout said top layer, said polymer granules comprising polyacrylamide.

15. The assembly of claim 14, wherein said polymer granules are spaced from said bottom layer and remain isolated therefrom after the fluid is absorbed and crystallized.

16. The assembly of claim of claim 13, wherein said bottom layer defines said top lip of said body, said top layer terminating prior to reaching said top lip.

17. The assembly of claim 13, wherein said adjustably securing means comprises:

first and second adhesive tabs directly connected to said top lip of said body, said first tab being disposed at said interior edge of said first portion such that said interior edge of said second portion can be folded downwardly and inwardly into said first portion and thereby permit said first and second tabs to maintain said second portion folded within said first portion.

18. The assembly of claim 13, wherein said bench comprises:

a bottom surface and a plurality of side walls monolithically formed therewith for providing privacy to a user when seated on said body.

* * * * *